US012219992B2

(12) United States Patent
Felix

(10) Patent No.: US 12,219,992 B2
(45) Date of Patent: Feb. 11, 2025

(54) CIGARETTE, LIGHTER STORAGE AND CIGARETTE BUTT STORAGE AND DISPOSAL DEVICE

(71) Applicant: Ryan Felix, Ajax (CA)

(72) Inventor: Ryan Felix, Ajax (CA)

( * ) Notice: Subject to any disclaimer, the term of this patent is extended or adjusted under 35 U.S.C. 154(b) by 55 days.

(21) Appl. No.: 18/054,205

(22) Filed: Nov. 10, 2022

(65) Prior Publication Data

US 2024/0156156 A1 May 16, 2024

(51) Int. Cl.
*A24F 15/18* (2006.01)
*A45F 5/02* (2006.01)

(52) U.S. Cl.
CPC ..... *A24F 15/18* (2013.01); *A45F 5/021* (2013.01); *A45F 2200/0566* (2013.01)

(58) Field of Classification Search
CPC ..... A24F 15/18; A24F 15/00; A24F 15/02; A24F 15/04; A24F 15/06; A24F 15/08; A24F 15/12; A24F 15/14; A24F 15/16; A24F 15/20; A45F 5/00; A45F 5/021; A45F 2200/00; A45F 2200/05; A45F 2200/0566
See application file for complete search history.

(56) References Cited

U.S. PATENT DOCUMENTS 6,321,757 B1 * 11/2001 McCutcheon ..... A24F 15/18 206/256
2005/0236282 A1 * 10/2005 Huska ..... A24F 13/18 206/242
2007/0215634 A1 * 9/2007 Levin ..... A61M 5/44 221/231
2021/0274839 A1 * 9/2021 Leite Alves ..... B65D 85/10

* cited by examiner

*Primary Examiner* — Javier A Pagan
(74) *Attorney, Agent, or Firm* — Orin Del Vecchio

(57) ABSTRACT

A cigarette storage and disposal device that is configured to be releasably secured to a user's belt or similar support element wherein the present invention is operable to provide storage of cigarettes, a lighter and further provide a compartment to receive and store cigarette butts subsequent consumption of a cigarette. The present invention includes a housing wherein the housing is divided into a first compartment, a second compartment and a third compartment. The first compartment is configured to receive, store and provide access to a cigarette lighter. The second compartment is operable to receive and retain cigarette butts for storage. The third compartment of the present invention includes is configured to receive, store and dispense cigarettes. The third compartment includes a track member having a cigarette movement member operably disposed therein. A belt clip member is present and is operable to secure the housing to a belt or similar object.

15 Claims, 7 Drawing Sheets

CIGARETTE, LIGHTER STORAGE AND CIGARETTE BUTT STORAGE AND DISPOSAL DEVICE

FIELD OF THE INVENTION

The present invention relates generally to smoking accessories, more specifically but not by way of limitation, a cigarette storage and disposal device wherein the present invention includes a housing that provides storage and access to unused cigarettes and further provides disposal compartment for ashes and the butt of the cigarette.

BACKGROUND

There are more than one billion smokers in the world today, and if current trends continue, that number is expected to increase to one and a half billion by the year 2025. China is home to more than three hundred million smokers and they consume approximately two trillion cigarettes a year. Worldwide, approximately ten million cigarettes are purchased a minute, fifteen billion are sold each day, and approximately five trillion are produced and used on an annual basis. Five trillion cigarette filters weigh approximately two billion pounds. It is estimated that billions of filters, filled with toxic chemicals from cigarette filters, make their way into the environment as discarded waste yearly. Cigarette filters are a threat to wildlife that could ingest them mistaking filters for food as well as a threat to other types of wildlife.

Toxin-filled cigarette butts work their way into our waterways primarily through storm drains that dump into streams and lakes. Studies conducted have shown that just one cigarette butt in approximately two gallons of water is lethal to water fleas, a tiny crustacean found in freshwater and saltwater. The small particles of tobacco left attached to cigarette filters carry more toxins than the filters do themselves. Most filters are discarded with bits of tobacco still attached to them as well, further polluting our environment with nicotine, which is poisonous. Used cigarette filters are full of toxins, which can leach into the ground and waterways, damaging living organisms that come into contact with them. The core of most cigarette filters is a form of plastic called cellulose acetate. By itself, cellulose acetate is very slow to degrade in our environment. Depending on the conditions of the area the cigarette butt is discarded in, it can take eighteen months to ten years for a cigarette filter to decompose. Many smokers often find themselves in locations where there are no apparatus to dispose butts after smoking a cigarette. As such it is common to discard the cigarette butt on the ground and stamp to extinguish wherein the butt will most often then find its way to a storm drain and produce the aforementioned undesirable effects.

Accordingly, there is a need for a cigarette storage and disposal device wherein the device can provide storage of cigarettes for consumption but further provide compartments for ash and/or butt storage in order to be subsequently disposed of properly.

SUMMARY OF THE INVENTION

It is the object of the present invention to provide a cigarette storage and disposal device configured to store unused cigarettes and further provide storage of butts wherein the present invention includes a housing with the housing having three interior compartments.

Another object of the present invention is to provide a portable device configured to be secured to a belt or other suitable support structure of a user wherein the device is operable to store cigarettes and used butts thereof wherein a first compartment is configured to receive and store therein a lighter.

A further object of the present invention is to provide a cigarette storage and disposal device configured to store unused cigarettes and further provide storage of butts wherein the second compartment of the present invention includes an interior volume configured to receive used cigarette butts therein.

Still another object of the present invention is to provide a portable device configured to be secured to a belt or other suitable support structure of a user wherein the device is operable to store cigarettes and used butts thereof wherein the first compartment and second compartment of the present invention include access panels formed on the top of the housing of the present invention.

An additional object of the present invention is to provide a cigarette storage and disposal device configured to store unused cigarettes and further provide storage of butts wherein the third compartment is configured to provide storage of unused cigarettes.

Yet a further object of the present invention is to provide a portable device configured to be secured to a belt or other suitable support structure of a user wherein the device is operable to store cigarettes and used butts thereof wherein the third compartment includes a cigarette movement mechanism that includes a track and a cigarette movement element.

Another object of the present invention is to provide a cigarette storage and disposal device configured to store unused cigarettes and further provide storage of butts wherein the cigarette movement element is operated utilizing a spring or similar biasing device.

Still a further object of the present invention is to provide a portable device configured to be secured to a belt or other suitable support structure of a user wherein the device is operable to store cigarettes and used butts thereof wherein the housing is secured to the belt of a user utilizing a belt clip member.

Yet an additional object of the present invention is to provide a cigarette storage and disposal device configured to store unused cigarettes and further provide storage of butts wherein the third compartment includes an aperture formed in the top wall of the housing that is configured to have a cigarette egress therethrough.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
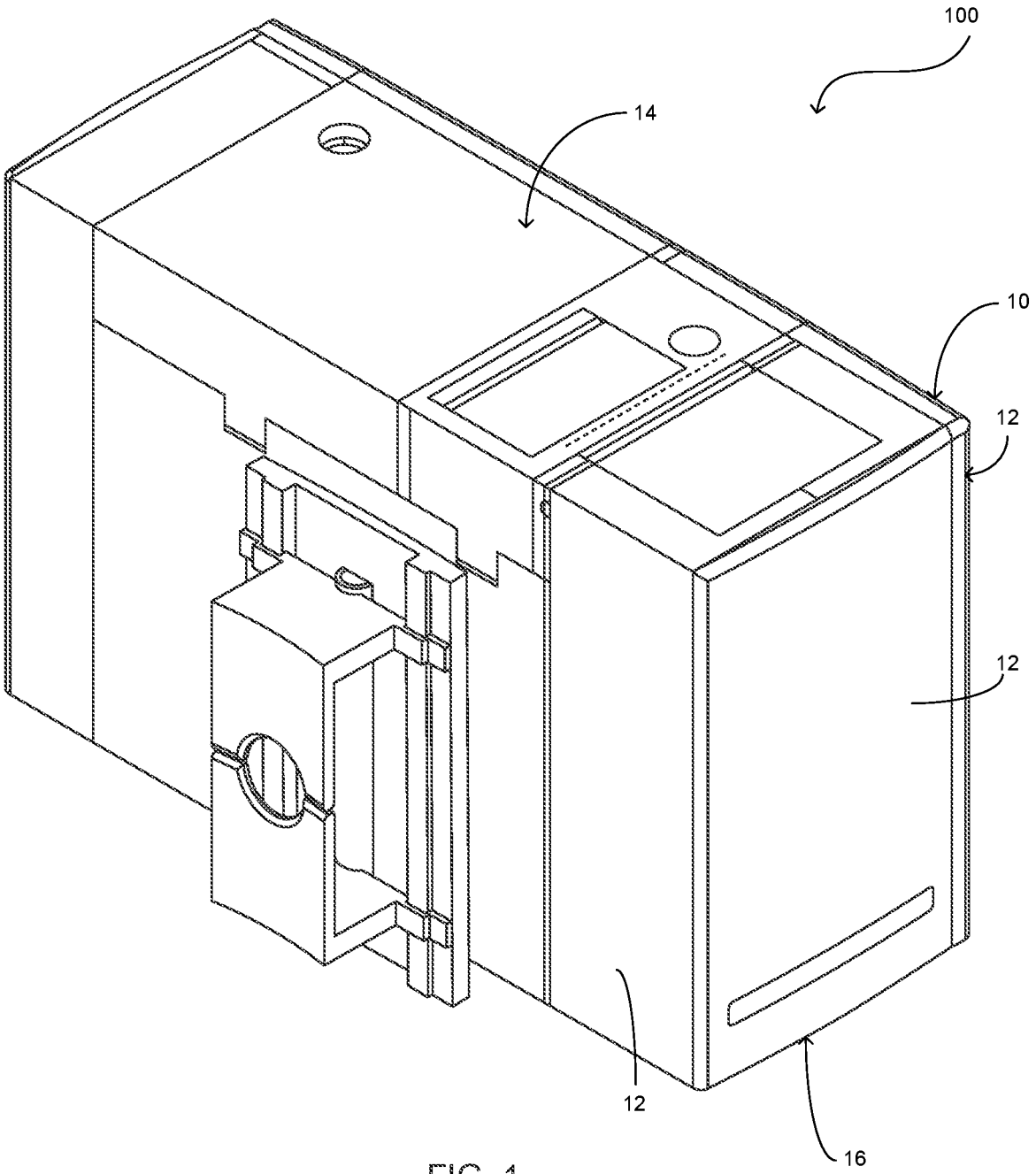
FIG. 1 is a rear perspective view of the present invention.
Figure 2:
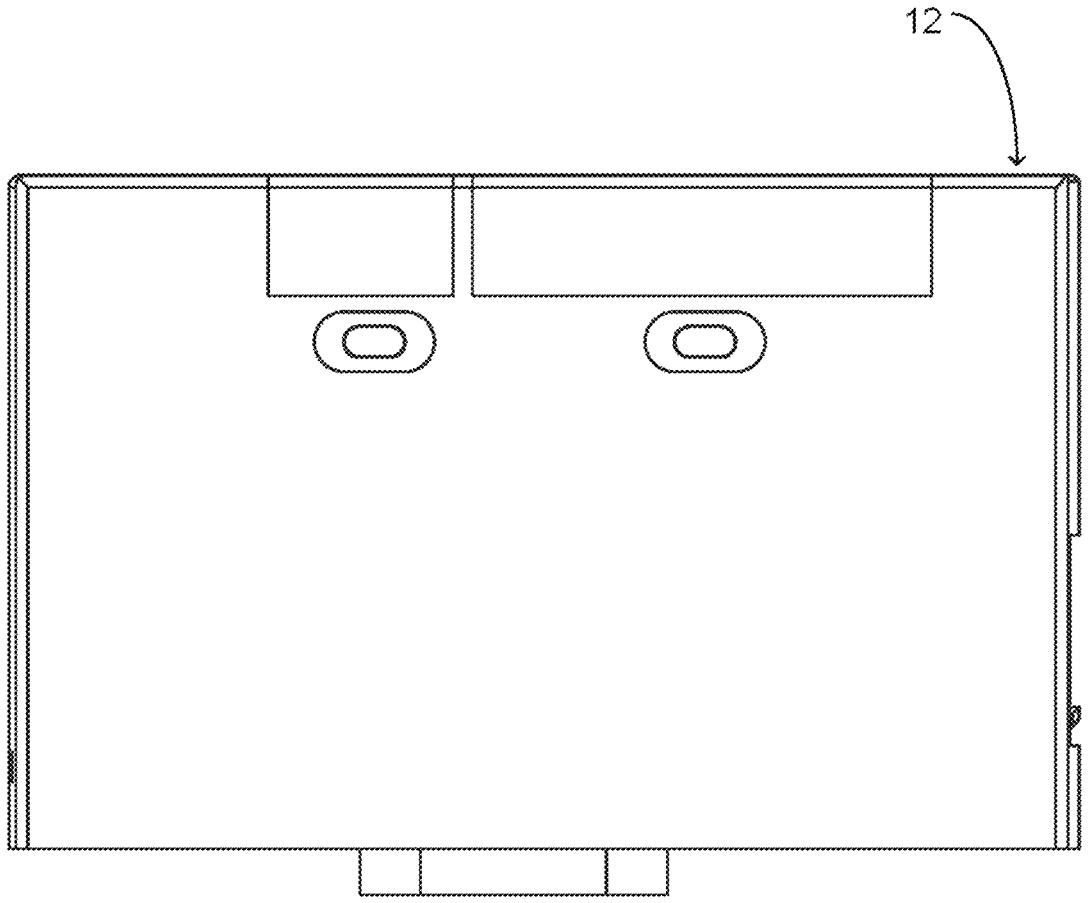
FIG. 2 is a front view of the present invention.
Figure 3:
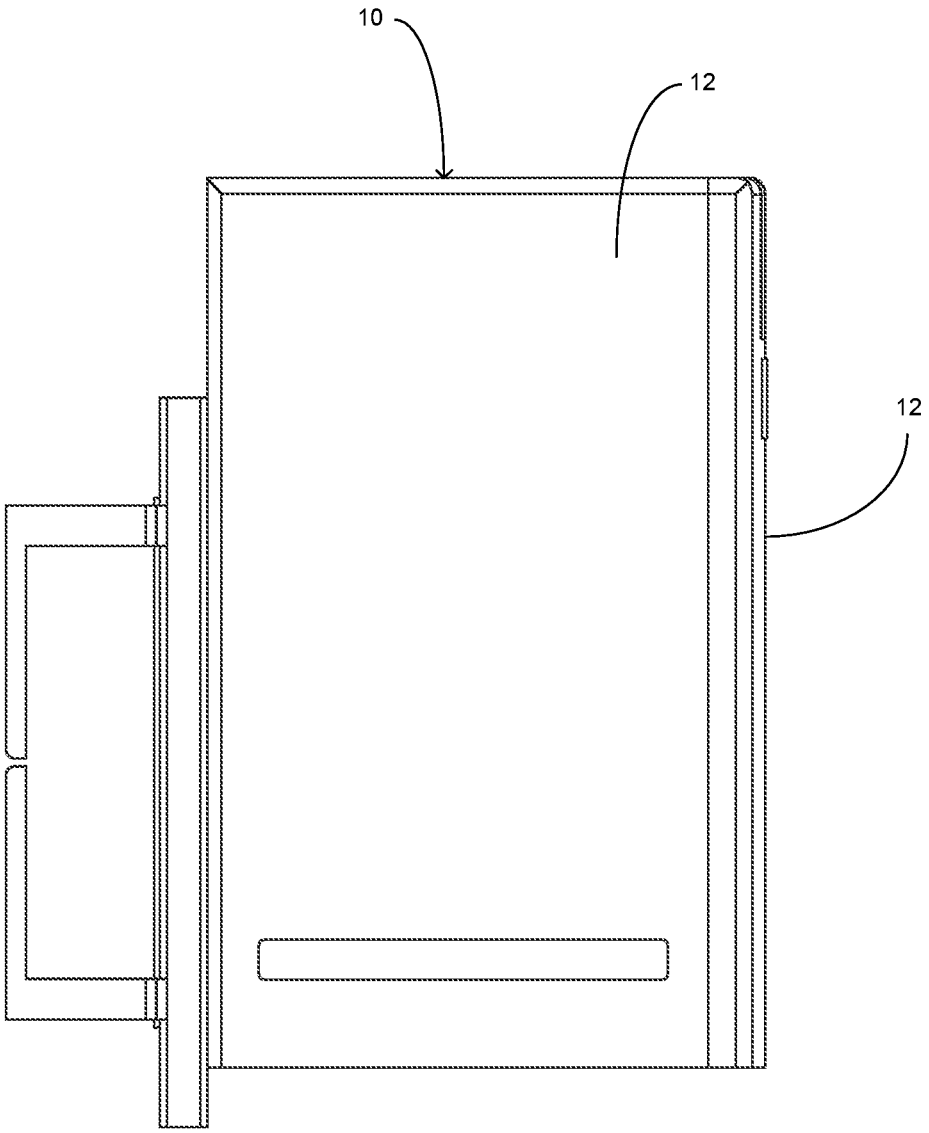
FIG. 3 is a side view of the present invention.
Figure 4:
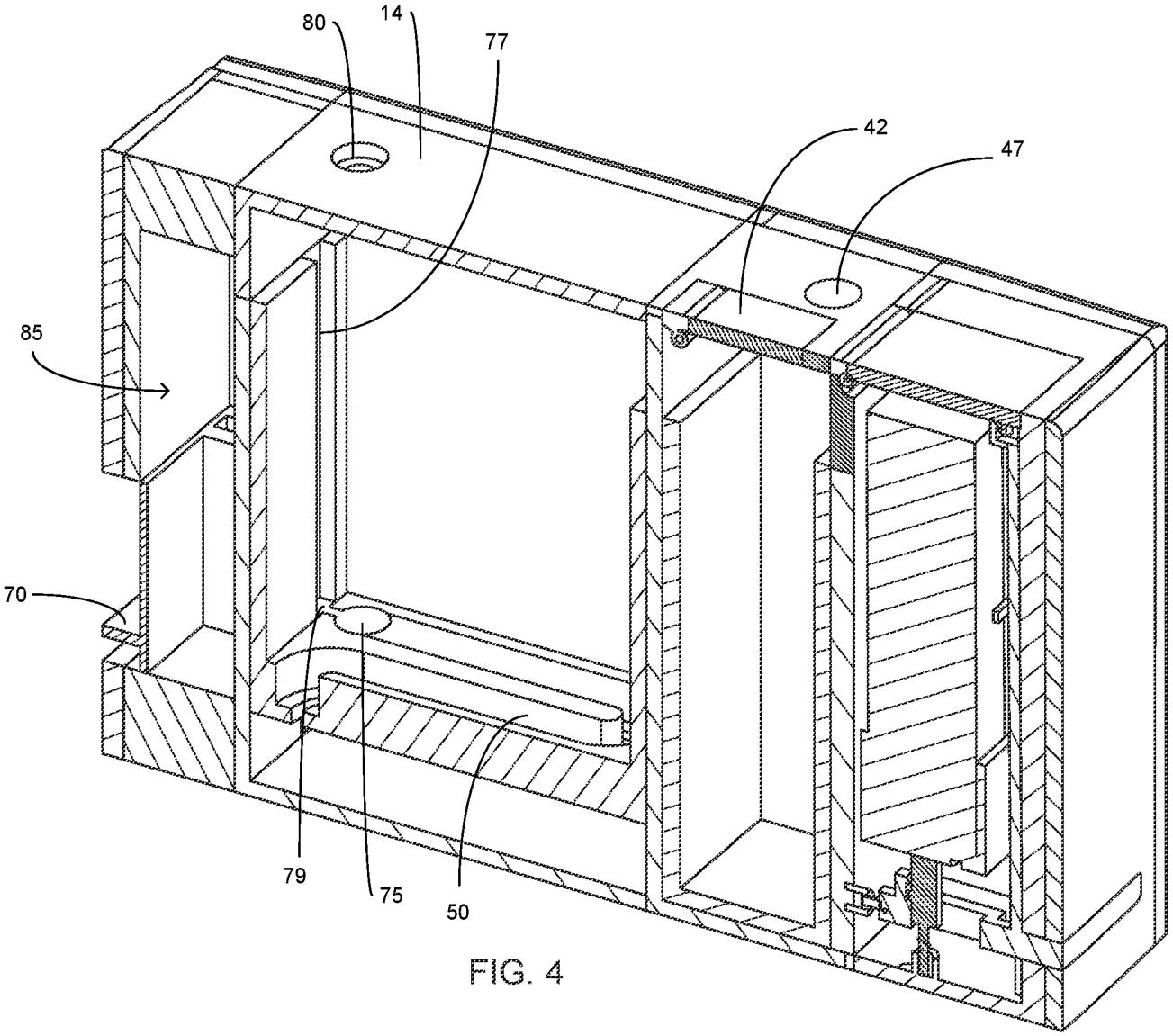
FIG. 4 is a cross-sectional view of the interior of the present invention.
Figure 5:
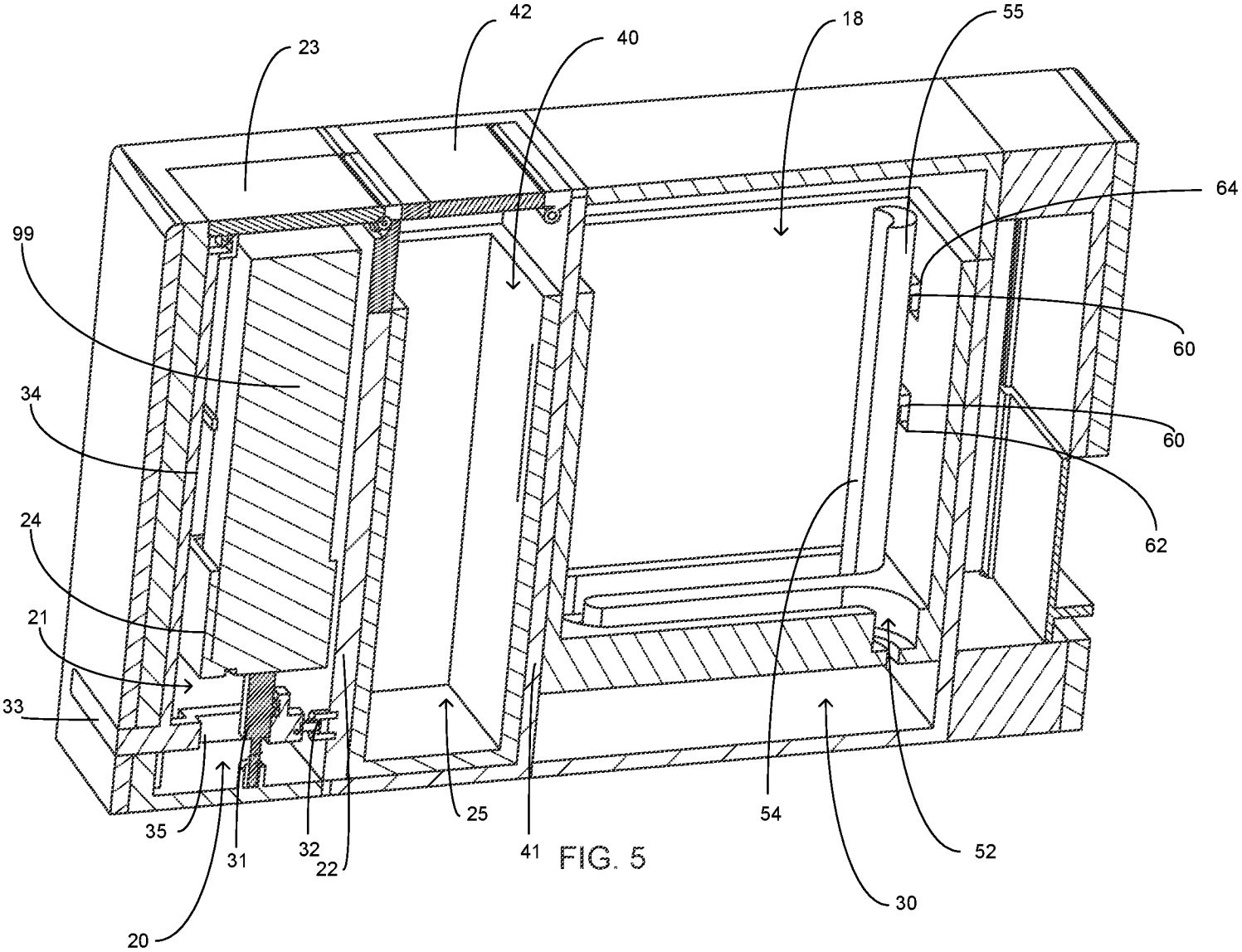
FIG. 5 is a cross-sectional view of the interior of the present invention.

Referring now to the drawings submitted herewith, wherein various elements depicted therein are not necessarily drawn to scale and wherein through the views and figures like elements are referenced with identical reference numerals, there is illustrated a cigarette storage and disposal device 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular the Figures submitted as a part hereof, the cigarette storage and disposal device 100 includes a housing 10. The housing 10 is manufactured from a lightweight rigid material such as but not limited to plastic. While the housing 10 is illustrated herein as being rectangular in shape it should be understood within the scope of the present invention that the housing 10 could be provided in alternate shapes and sizes. The housing 10 is comprised of a plurality of walls 12, a top 14 and a bottom 16 integrally formed to create an interior volume 18. The interior volume 18 is divided into a first compartment 20, a second compartment 25 and a third compartment 30. The first compartment 20 includes interior volume 21 defined by wall member 22. The first compartment 20 is configured to receive, store and provide access to a conventional cigarette lighter 99 illustrated herein in block diagram form. The cigarette lighter 99 is placed within the interior volume 21 through access panel 23.

Access panel 23 is hingedly secured to the top 14 utilizing suitable conventional hinge mechanisms. The access panel 23 is movable between and open and closed position providing access to the interior volume 21. A support member 24 is movably mounted within the interior volume 21 and is configured to have the cigarette lighter 99 superposed thereon. The support member 24 is movable in an upwards-downwards motion utilizing spring member 31. Spring member 31 is operably coupled with latch 32 and control lever 33 wherein the control lever 33 is engaged by a user to move the support member 24 from its first position to its second position. In the first position the support member 24 is held proximate the bottom 16 with the latch 32. This allows the cigarette lighter 99 to be fully disposed within the interior volume 21. Upon engagement of control lever 33 the portion 34 moves the access panel 23 to its open position and the portion 35 releases the spring member 31 in order to move the support member 24 to its second position wherein the support member 24 traverses upwards to place a portion of the cigarette lighter 99 above the top 14 in order to be accessed by a user of the cigarette storage and disposal device 100. While elements have been illustrated and discussed herein for providing storage and accessibility to the cigarette lighter 99, it is contemplated within the scope of the present invention that alternate elements could be employed to achieve the desired objective discussed herein.

The second compartment 25 is adjacent to first compartment 20 and is configured to receive cigarette butts as well as ashes into the interior volume 40 thereof. The second compartment 25 is defined by wall member 22 and wall member 41 wherein access to the interior volume 40 is through access panel 42. The access panel 42 is hingedly secured to the top 14 and is movable between an open position and a closed position. The interior volume 40 is provided in a sufficient size so as to have the capacity to receive and retain therein a plurality of cigarette butts therein. It should be understood within the scope of the present invention that the second compartment 25 could be provided in alternate shapes and further have various elements operable to provide access to the interior volume 40 thereof. The second compartment 25 further includes an aperture 47 formed in the top 14. Aperture 47 is annular in shape and is of sufficient diameter so as to have a cigarette butt journaled therethrough in order to be deposited into the second compartment 25.

The third compartment 30 is configured to receive, retain and dispense a plurality of cigarettes. The third compartment 30 includes track member 50 formed in the bottom thereof. The track member 50 has a width and a void 52 operable to receive a portion of a butt of a cigarette wherein the cigarettes are placed in a vertical position and stacked adjacent to each other within the track member 50. A cigarette movement member 55 is operably coupled within the third compartment 30. The cigarette movement member 55 is configured to traverse the plurality of cigarettes through the track member 50 as a user of the cigarette storage and disposal device 100 ejects a cigarette from the third compartment 30 as is further discussed herein. The cigarette movement member 55 is elongated and cylindrical in shape having an arcuate formed front surface 54. The arcuate form to the front surface 54 is to mateably accommodate a cigarette as the radius of the front surface 54 is formed to match the radius of a cigarette. Forming the radius of the front surface 54 ensures no damage to the cigarette engaged with the cigarette movement member 55 as the cigarette movement member 55 traverse the group of cigarettes along the track member 50. The cigarette movement member 55 is operably coupled to biasing members 60. Biasing members 60 provide operational motion of the cigarette movement member 55. The biasing members 60 are mounted in voids 62,64 wherein the voids 62,64 allow for upwards-downwards movement of the biasing members 60. The biasing members 60 are operably coupled to ejector lever 70 wherein alternate positions thereof affect the biasing members 60. During the position of the ejector lever 70 being proximate the bottom 16, the biasing members 60 are positioned higher within the voids 62,64 which locks the biasing members 60 in position and inhibits any force onto the cigarette movement member 55. This allows for no pressure to be exerted onto the cigarettes until a user of the cigarette storage and disposal device 100 desires to extract a cigarette therefrom so as to inhibit any potential damage thereto. During engagement of the ejector lever 70 the biasing members 60 are moved downward in the voids 62,64 so as to permit a force from the biasing members 60 to be exerted onto the cigarette movement member 55. This force traverses the cigarettes along the track member 50 to place a cigarette directly over the lift member 75.

Lift member 75 is movably mounted within groove 77 and operably coupled to ejector lever 70. Lift member is annular in shape and is sized to be disposed within the track member 50 in its lowest position so as to have a cigarette superposed on the upper surface thereof. The lift member 75 is operably coupled to ejector lever 70 with arm member 79. Arm member 79 is slidable within groove 77 and is moved in an upwards-downwards movement therein. The lift member 75 is axially aligned with the upper aperture 80. Upper aperture 80 is formed in the top 14 and is annular in shape having a diameter that is sufficient to accommodate a cigarette therethrough. In use, to facilitate removal of a cigarette for consumption thereof, a user will engage the ejector lever 70 and move in an upwards movement resulting in an upward movement of the lift member 75. The lift member 75 traverses along the groove 77 of a sufficient distance so as to place a portion of a cigarette superposed thereon through the aperture above the top 14 to be grasped by the user. The ejector lever 70 is housed in a void 85 wherein the void 85 is formed in the housing 10 and is of sufficient size so as to accommodate the aforementioned movement of the ejector lever 70.

Figure 6:
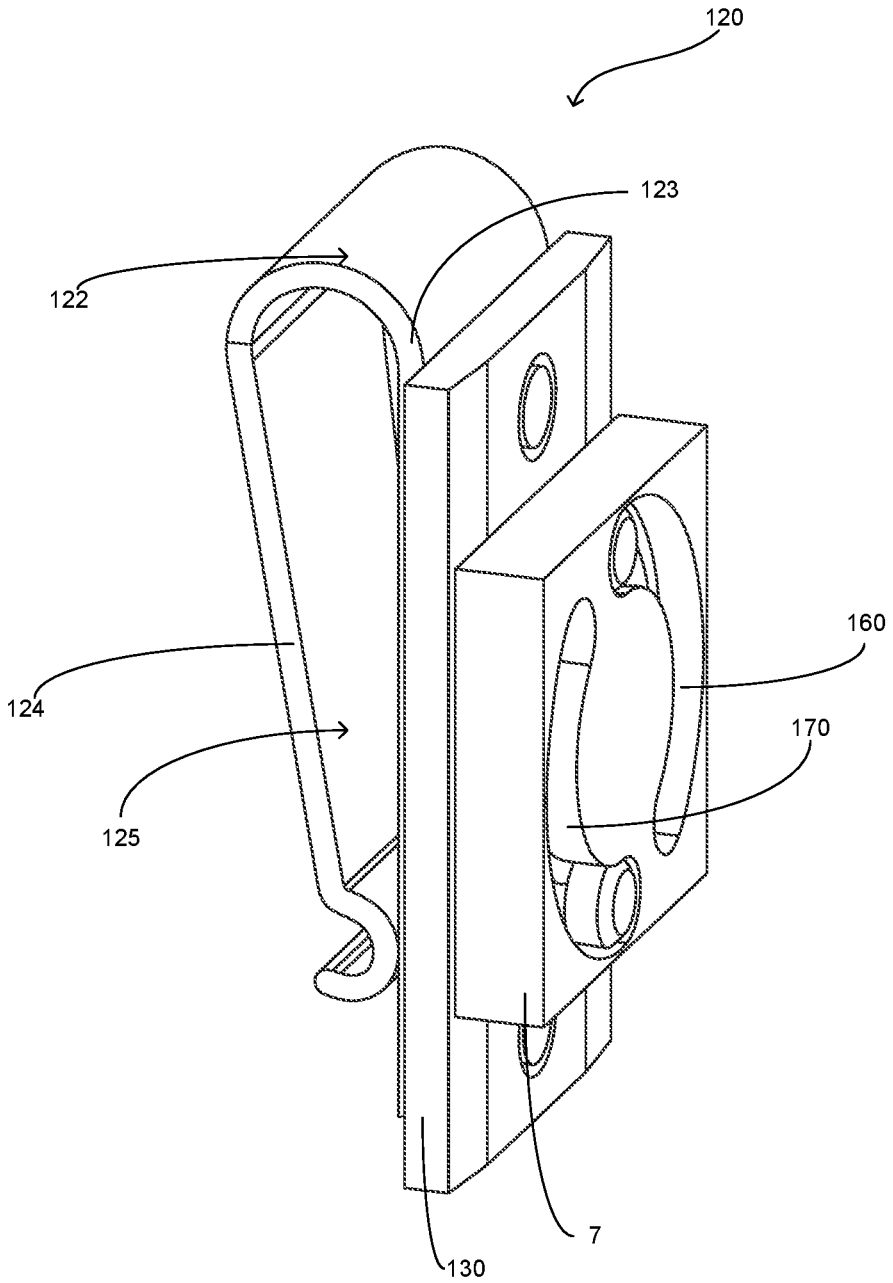
FIG. 6 is a side perspective view of the belt clip member of the present invention.
Figure 7:
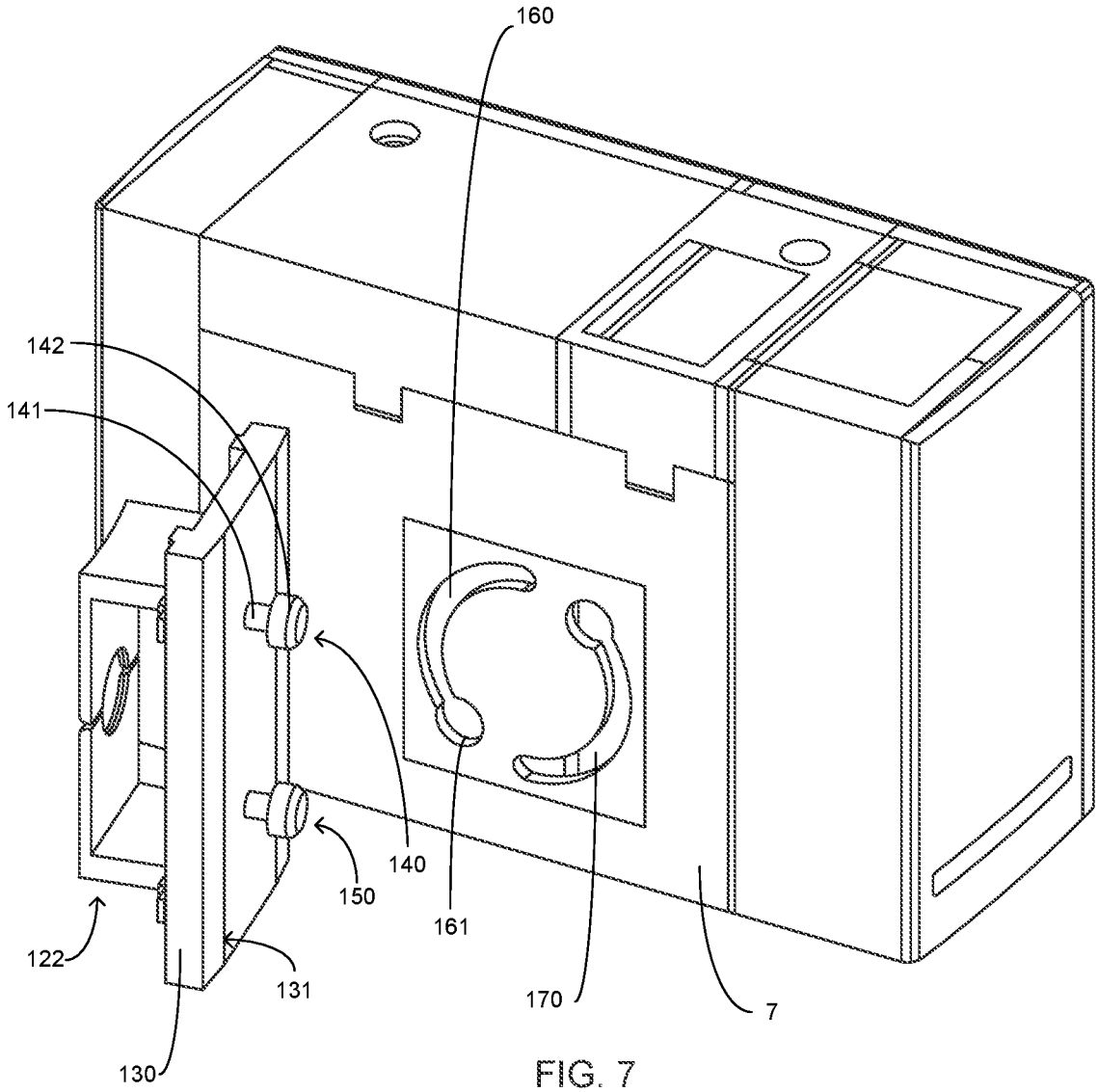
FIG. 7 is a rear perspective view of the invention with the belt clip member removed therefrom.

Referring in particular to FIG. 6 and FIG. 7, an embodiment of the belt clip member 120 is illustrated therein. The cigarette storage and disposal device 100 in a preferred embodiment is configured to be releasably secured to a belt or similar object of the user providing easy access thereto. While an embodiment of the belt clip member 120 is illustrated and discussed herein, it should be understood within the scope of the present invention that the cigarette storage and disposal device 100 could employ alternate embodiments of the belt clip member 120 in order to achieve the desired functionality thereof. The belt clip member 120 includes securing member 122. The securing member 122 is comprised of a contiguous first portion 123 and a second portion 124 that are operable to secure the belt clip member 120 to a belt or similar object. The securing member 122 is formed to create a bias force from the second portion 124 onto the base member 130 wherein the force is configured to ensure that a belt or similar object disposed within the void 125 maintains engagement with the belt or similar object. As is shown in FIG. 7 herein the securing member 122 can be provided in alternate forms to achieve the desired objective discussed herein.

The belt clip member 120 includes a base member 130. Base member 130 is secured to the securing member 122 utilizing suitable durable techniques. The base member 130 in a preferred embodiment is rectangular in shape having a first surface 131 configured to have a first support member 140 and a second support member 150 integrally formed therewith and extending outward therefrom. The first support member 140 and the second support member 150 are identically constructed being axially aligned having a space therebetween. The first support member 140 and second support member 150 are configured to be operably coupled with first groove 160 and second groove 170 formed in the rear wall 7 of the housing 10. The first support member 140 includes first section 141 that is contiguously formed with second section 142. First section 141 is cylindrical in shape and extends outward from the first surface 131 being perpendicular thereto. The second section 142 is integrally formed with first section 141 and has a diameter that is larger than that of the first section 141. The second section 142 is configured to be journaled into the end 161 of the first groove 160. Ensuing insertion of the second section 142 the housing 10 is rotated wherein the second section 142 is adjacent but past the first groove 160. This in combined with an identical formation for the second support member 150 coupling with the second groove 170 releasably secures the housing 10 to the belt clip member 120. While a particular configuration of the belt clip member 120 has been illustrated and discussed herein, it is contemplated within the scope of the present invention that the belt clip member 120 could be provided in alternate embodiments and achieve the desired objective herein.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A cigarette storage and disposal device configured to be releasably secured to a user wherein the cigarette storage and disposal device comprises:

a housing, said housing having a plurality of walls, a bottom and a top being integrally formed to create an interior volume;

a first compartment, said first compartment being formed within the interior volume of said housing, said first compartment having an access panel formed in the top providing access thereto, said first compartment having a support member, said support member being movably mounted within said first compartment, said support member movable in an upwards-downwards motion, said support member having an upper surface configured to have an item superposed thereon;

a second compartment, said second compartment being disposed within said interior volume of said housing, said second compartment being adjacent said first compartment, said second compartment having an interior volume, said second compartment having an access panel formed in the top providing access to the interior volume of the second compartment; and a third compartment, said third compartment having an interior volume, said third compartment configured to receive and store a plurality of cigarettes in a row formation, said third compartment having a track member formed in a bottom thereof, said track member having a void of suitable size to accommodate a cigarette in a vertical position, said third compartment further including a cigarette movement member, said cigarette movement member being movably mounted within the third compartment having a portion thereof disposed in the void of the track member; and a lifting member, said lifting member being located proximate an end of the track member, said lifting member configured to move in an upwards-downwards motion, said lifting member being operable to elevate a single cigarette out of the third compartment.

2. The cigarette storage and disposal device as recited in claim 1, and further including an ejector lever, said ejector lever being operably coupled to said lifting member, said ejector lever having a portion thereof accessible exteriorly with respect to the housing.

3. The cigarette storage and disposal device as recited in claim 2, wherein the third compartment further includes an aperture, said aperture being formed in the top over the third compartment, said aperture being in axial alignment with said lifting member.

4. The cigarette storage and disposal device as recited in claim 3, wherein said support member disposed in said first compartment is operably coupled to a spring member, said spring member being operably coupled to a latch, wherein the latch maintains the support member in a first position proximate a bottom of the first compartment.

5. The cigarette storage and disposal device as recited in claim 4, wherein the latch is operably coupled to a control lever, said control lever having a first portion and a second portion, wherein the first portion is coupled to the spring member.

6. The cigarette storage and disposal device as recited in claim 5, wherein the second portion of the control lever is operably coupled to the access panel of the first compartment.

7. The cigarette storage and disposal device as recited in claim 6, and further including a first biasing member and a second biasing member, said first biasing member and said second biasing member being operably coupled to said cigarette movement member, said first biasing member and said second biasing member configured to provide a force to said cigarette movement member in order to progress a row of cigarettes disposed in the track member subsequent removal of a cigarette from an end of the row of cigarettes.

8. The cigarette storage and disposal device as recited in claim 7, wherein said cigarette movement member is elongated and cylindrical in shape having a curved front surface.

9. The cigarette storage and disposal device as recited in claim 8, wherein the ejector lever is housed in a void formed in an end wall, said ejector lever being movable in an upwards-downwards direction in the void formed in the end wall.

10. A cigarette storage and disposal device configured to be releasably secured to a belt or similar article being worn by a user wherein the cigarette storage and disposal device comprises:

a housing, said housing having a plurality of walls, a bottom and a top being integrally formed to create an interior volume, said housing being rectangular in shape;

a first compartment, said first compartment being formed within the interior volume of said housing, said first compartment having an access panel formed in the top providing access thereto, said first compartment having a support member, said support member being movably mounted within said first compartment, said support member movable in an upwards-downwards motion, said support member being operably coupled to a spring member, said spring member configured to provide the motion of the support member, said spring member being operably coupled to a latch, said latch configured to maintain said spring member in a compressed position when engaged with said spring member;

a second compartment, said second compartment being disposed within said interior volume of said housing, said second compartment being adjacent said first compartment, said second compartment having an interior volume, said second compartment having an access panel formed in the top providing access to the interior volume of the second compartment; and a third compartment, said third compartment having an interior volume, said third compartment configured to receive and store a plurality of cigarettes in a row formation, said third compartment having a track member formed in a bottom thereof, said track member having a void of suitable size to accommodate a cigarette in a vertical position, said third compartment further including a cigarette movement member, said cigarette movement member being movably mounted within the third compartment having a portion thereof disposed in the void of the track member, said cigarette movement member being elongated and cylindrical in form, said cigarette movement member having a front surface having an arcuate shape that is mateable to a radius of a cigarette so as to mateably connect therewith;

a lifting member, said lifting member being located proximate an end of the track member, said lifting member configured to move in an upwards-downwards motion, said lifting member being operable to elevate a single cigarette out of the third compartment, said lifting member being operably coupled to an ejector lever via an arm member, said arm member being located in a groove formed in an end wall wherein the end wall has a void configured to retain said ejector lever.

11. The cigarette storage and disposal device as recited in claim 10, and further including a first biasing member and a second biasing member, said first biasing member and said second biasing member being operably coupled to said cigarette movement member, said first biasing member and said second biasing member being mounted in voids in the end wall, said voids allowing said first biasing member and said second biasing member to be moved intermediate a first position and a second position, said first biasing member and said second biasing member in said second position being configured to provide a force to said cigarette movement member in order to progress a row of cigarettes disposed in the track member subsequent removal of a cigarette from an end of the row of cigarettes.

12. The cigarette storage and disposal device as recited in claim 11, wherein the third compartment further includes an aperture, said aperture being formed in the top over the third compartment, said aperture being in axial alignment with said lifting member, said aperture configured to have a portion of a cigarette superposed the lifting member extend outward therefrom.

13. The cigarette storage and disposal device as recited in claim 12, wherein the latch is operably coupled to a control lever, said control lever having a first portion and a second portion, wherein the first portion is coupled to the spring member, said second portion being operably coupled to the access panel of the first compartment.

14. The cigarette storage and disposal device as recited in claim 13, and further including a belt clip member, said belt clip member having a base member, said base member having a first support member and second support member extending outward therefrom, said first support member and said second support member having a first section and second section, said second section having a diameter that is greater than that of said first section.

15. The cigarette storage and disposal device as recited in claim 14, wherein the housing includes a rear wall, said rear wall having a first groove and a second groove formed in a circular pattern within said rear wall, said first groove and said second groove being configured to mateably couple with said first support member and said second support member.

* * * * *